US009044082B2

(12) United States Patent
Kusuma et al.

(10) Patent No.: US 9,044,082 B2
(45) Date of Patent: Jun. 2, 2015

(54) COLLAPSIBLE CONTAINER

(75) Inventors: David D. Kusuma, Orlando, FL (US); Raymond J. Trudeau, St. Cloud, FL (US); Hector J. Barea, Orlando, FL (US)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 13/452,240

(22) Filed: Apr. 20, 2012

(65) Prior Publication Data

US 2013/0277364 A1 Oct. 24, 2013

(51) Int. Cl.
*B65D 8/14* (2006.01)
*A45F 3/20* (2006.01)

(52) U.S. Cl.
CPC ..... *A45F 3/20* (2013.01); *A45F 2003/205* (2013.01)

(58) Field of Classification Search
CPC .... B65D 21/086; B65D 11/1893; A45F 3/20; A45F 2220/106; A45F 2220/1063; A45F 2220/1066; A45C 7/0077; A45C 7/00
USPC ..... 220/8, 666, 672, 675, 9.4, 9.2, 669, 220/4.28; 215/900, 382
See application file for complete search history.

(56) References Cited

U.S. PATENT DOCUMENTS

| | | | | | |
|---|---|---|---|---|---|
| 216,227 | A | * | 6/1879 | Sedgwick | 220/9.2 |
| 1,233,117 | A | * | 7/1917 | Parker | 220/9.2 |
| 1,454,388 | A | * | 5/1923 | Waldemar | 220/9.2 |
| 2,880,902 | A | | 4/1959 | Owsen | |
| 3,009,603 | A | | 11/1961 | Stockdale | |
| 3,220,544 | A | * | 11/1965 | Lovell | 206/218 |
| 3,285,459 | A | | 11/1966 | Gahm | |
| D219,473 | S | | 12/1970 | Gahm | |
| D219,475 | S | | 12/1970 | Gahm | |
| 4,930,644 | A | | 6/1990 | Robbins, III | |
| 4,955,493 | A | * | 9/1990 | Touzani | 215/372 |
| 5,002,193 | A | * | 3/1991 | Touzani | 215/396 |
| D347,359 | S | | 5/1994 | Robbins, III | |
| 5,348,173 | A | | 9/1994 | Norwood | |
| 5,384,138 | A | * | 1/1995 | Robbins et al. | 426/111 |
| 5,439,128 | A | * | 8/1995 | Fishman | 220/8 |
| 5,549,213 | A | | 8/1996 | Robbins, III et al. | |
| 5,575,398 | A | | 11/1996 | Robbins, III | |
| D381,559 | S | | 7/1997 | Browne | |
| 5,669,520 | A | * | 9/1997 | Simpson | 215/11.1 |
| 5,960,983 | A | * | 10/1999 | Chan | 220/666 |
| D441,252 | S | | 5/2001 | Gitschlag | |
| 6,431,393 | B1 | * | 8/2002 | Stewart | 220/826 |
| 6,520,365 | B2 | * | 2/2003 | Schneider | 220/9.2 |
| 6,554,154 | B1 | | 4/2003 | Chauhan et al. | |

(Continued)

FOREIGN PATENT DOCUMENTS

| | | | |
|---|---|---|---|
| CN | 1095031 | A | 11/1994 |
| EP | 1972242 | A3 | 10/2008 |
| FR | 1124843 | A | 10/1956 |

*Primary Examiner* — Steven A. Reynolds
(74) *Attorney, Agent, or Firm* — Taylor J. Ross

(57) ABSTRACT

A collapsible container having a rigid base, a rigid top ring, and rigid intermediate rings extending therebetween. A flexible peripheral wall is intimately bonded to the base, top ring, and intermediate rings, to form wall sections having alternating sections of flexible material and flexible material intimately bonded to the intermediate rings, whereby the container is adjustable between an expanded position with the top ring spaced upward from said base and forming a container interior, and a collapsed position with said top ring surrounding said base in outwardly spaced substantially concentric relation thereto.

20 Claims, 8 Drawing Sheets

(56) References Cited

U.S. PATENT DOCUMENTS

| | | | | |
|---|---|---|---|---|
| 6,612,453 | B2 * | 9/2003 | Joo-Tai | 220/9.2 |
| 6,616,004 | B1 * | 9/2003 | Erickson et al. | 220/9.2 |
| D483,225 | S | 12/2003 | Gain | |
| D507,458 | S | 7/2005 | Allen et al. | |
| D550,036 | S | 9/2007 | Holcomb et al. | |
| 7,350,385 | B1 * | 4/2008 | Book | 70/456 R |
| D580,799 | S | 11/2008 | Curtin | |
| D607,692 | S | 1/2010 | Skala | |
| 7,654,402 | B2 * | 2/2010 | Kusuma et al. | 220/8 |
| 7,678,271 | B2 | 3/2010 | Curtin | |
| 7,815,069 | B1 * | 10/2010 | Bellofatto et al. | 220/666 |
| 7,866,500 | B1 * | 1/2011 | Peggs | 220/6 |
| 8,061,548 | B1 * | 11/2011 | Peggs | 220/530 |
| 8,313,000 | B1 * | 11/2012 | Tuan | 220/6 |
| 2003/0106895 | A1 * | 6/2003 | Kalal | 220/9.2 |
| 2003/0183630 | A1 * | 10/2003 | Schneider et al. | 220/9.2 |
| 2003/0230588 | A1 * | 12/2003 | Zepter | 220/669 |
| 2004/0155038 | A1 * | 8/2004 | Smith | 220/9.2 |
| 2005/0127073 | A1 * | 6/2005 | Kusuma et al. | 220/6 |
| 2005/0127074 | A1 * | 6/2005 | Kusuma et al. | 220/6 |
| 2006/0081555 | A1 * | 4/2006 | Mori et al. | 215/381 |
| 2008/0099476 | A1 * | 5/2008 | Fung | 220/6 |
| 2008/0135550 | A1 * | 6/2008 | Williams | 220/9.2 |
| 2009/0101641 | A1 * | 4/2009 | Fu | 220/7 |
| 2009/0114657 | A1 * | 5/2009 | Hsu | 220/574 |
| 2009/0183565 | A1 * | 7/2009 | Shamoon et al. | 73/426 |
| 2010/0140279 | A1 | 6/2010 | Tyson et al. | |
| 2010/0183773 | A1 | 7/2010 | Malone et al. | |
| 2011/0248037 | A1 * | 10/2011 | Fung | 220/592.2 |
| 2012/0227860 | A1 * | 9/2012 | Jeremiah | 141/1 |

* cited by examiner

FIG. 15
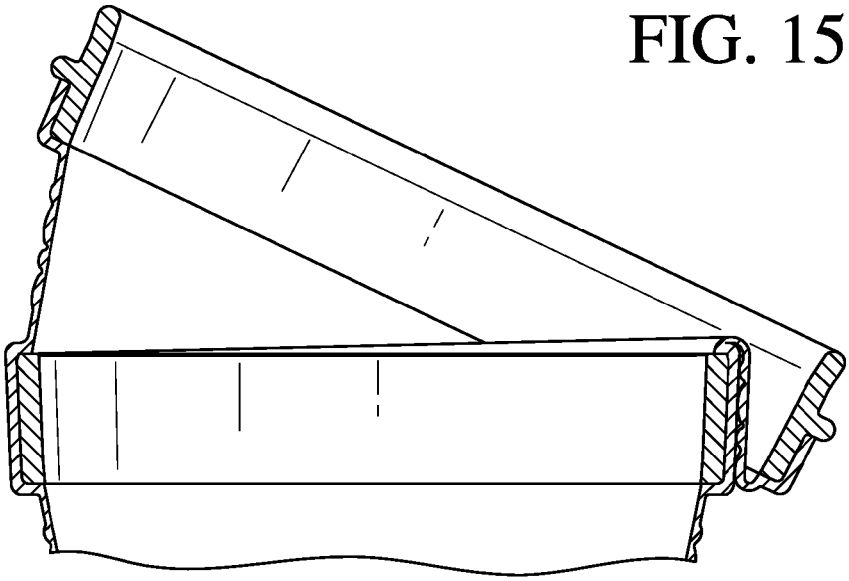
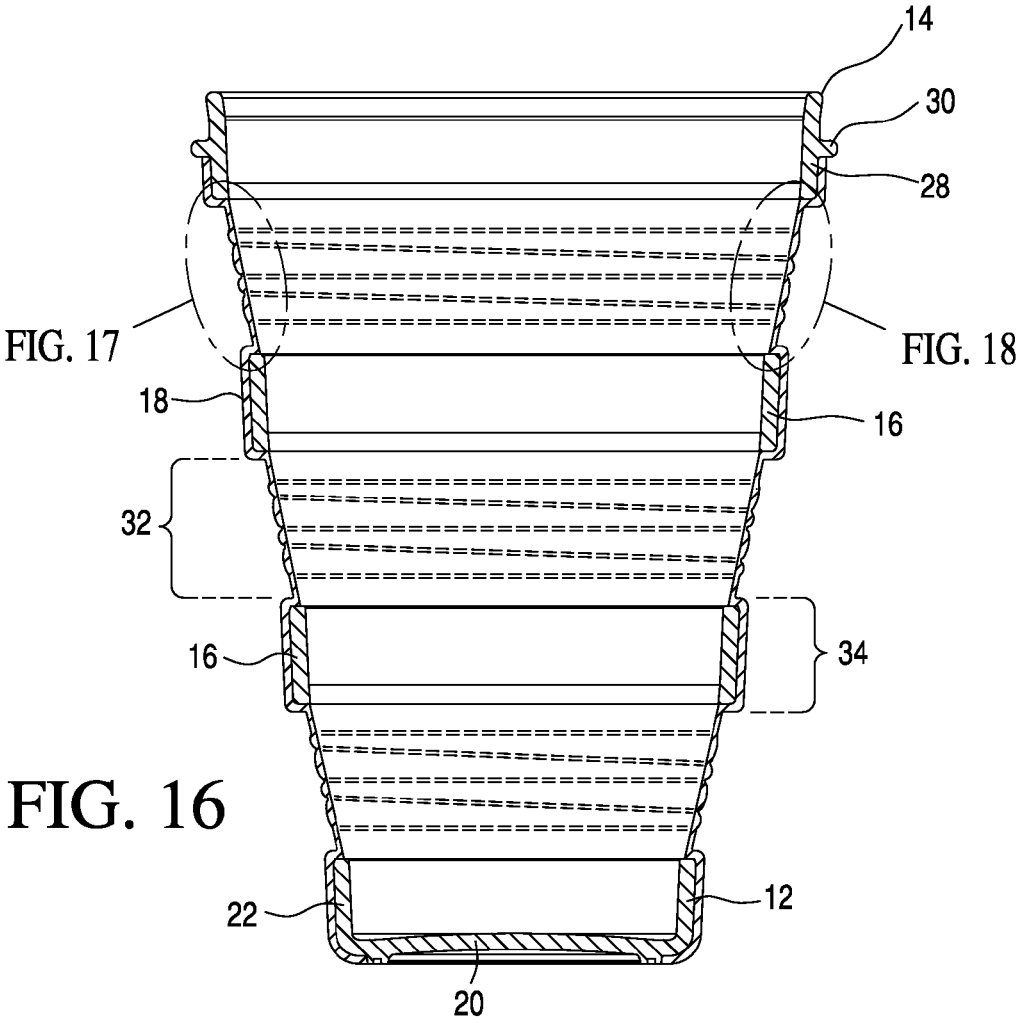
FIG. 16

COLLAPSIBLE CONTAINER

BACKGROUND OF THE INVENTION

The present invention generally relates to molded plastic containers of the type commonly used for a variety of purposes including storage of both food items and non-food items, such containers preferably being adapted to receive an appropriate seal or lid. More specifically, the invention is concerned with containers of this type which, rather than being of a rigid construction as with a conventional container, are collapsible or foldable to a compact position when empty to facilitate convenient use and storage.

Such containers, in the form of tumblers, cups, bowls, and the like, are generally known in the art and take many forms. These include collapsible cups or glasses wherein the glass is formed of telescopically stacked annular wall elements which slide relative to each other between a fully extended position and a collapsed position. As the wall elements are not integrally formed and slide freely relative to each other, there is a substantial possibility of leakage, and use, other than as a temporary drinking vessel, is not practical.

One form of collapsible container is illustrated in U.S. Pat. No. 5,439,128, issued to Fishman on Aug. 8, 1995. In the Fishman container, the wall elements are integrally molded and consist of a series of vertical and angled elements alternately stacked to define the container wall. The elements, at the angular joint therebetween, are integrally joined by thin film hinges about which the wall elements fold. The actual downward folding and collapsing of the Fishman elements requires that the elements flex in order to accommodate the folding motion. This necessity for an actual flexing of the elements themselves, in addition to the folding at the film hinges, appears to be so significant as to, at least, in some instances, as illustrated in FIG. 3 of Fishman, require significant central relief grooves in each of the inclined wall elements which would appear to cause an inherent weakening of these wall elements.

Another collapsible container is illustrated in U.S. Pat. No. 7,654,402, issued to Kusuma et al. on Feb. 2, 2010. In the Kusuma container, angularly related multiple folding sections extend at an angle to the vertical, and include, within each section itself, a "flexure zone" adjacent the angular joint between adjacent sections and flexibly movable between a first open position in the expanded container and a second position folded upon itself in the collapsed container. The flexure zones resist movement of the sections in both the fully expanded container and the collapsed container, as well as any intermediate position wherein only selected flexure zones are in an open position. One disadvantage of this arrangement, however, is that, as the diameter of the opening in the container decreases, the amount of force required to collapse or expand the container increases to the point of being less practical to use. The Kusuma container is therefore best suited for containers having a relatively large diameter.

Another form of collapsible cup more pertinent to the present invention is illustrated in U.S. Pat. No. 2,880,902, issued to Owsen on Apr. 7, 1959. In the Owsen cup, the wall elements are integrally molded in a single molding step, and comprise a plurality of annular and relatively thick wall sections alternating with annular thin wall sections, all of which are of successively decreasing diameter from the top to the bottom of the cup. Due to the fact that the body is made of a flexible plastic material, the thin wall sections are relatively more flexible than the thick wall sections, and each thin wall section will consequently reversely move over itself into an inside out or inverted position, when the thick wall sections of different diameters are moved into telescopic relation. With the single molding step described by Owsen, however, there is no possibility to obtain an optimal hardness to softness ratio for the annular sections of a collapsible cup, which can be achieved through the use of two different materials in a multiple injection molding process.

A collapsible container is also shown in U.S. Pat. No. 5,575,398, issued to Robbins, III on Nov. 19, 1996. The Robbins, III container is also extrusion or blow molded in a single molding step, and comprises a bottom wall and relatively flexible peripheral side walls extending upwardly from the bottom wall, the side walls being connected by areas of reduced side wall thickness, to facilitate the collapsing of the container.

A collapsible container has not heretofore particularly lent itself to formation from two materials of differing hardness, flexibility, or rigidity, in the collapsible section of the container. This allows the container to be collapsed with less force than is required for existing containers having a collapsible section comprised of only one type of material, and is particularly desirable where the container is to be used by children or elderly persons having limited mobility or dexterity in their hands and/or fingers.

SUMMARY OF THE INVENTION

A principal object of the present invention is to provide a collapsible container which presents or forms a substantially rigid receptacle in its open or expanded position and which, with an appropriate watertight lid or seal snap-fitted thereto, provides a practical watertight storage container for, as an example, an appropriate beverage, or the like. The container is very convenient and provides a particularly desirable portable solution for drinks "on-the-go", such as at picnics, lunches for those who take their own lunch to work, and other instances wherein temporary storage of liquids is desired. The collapsible nature of the container, collapsing to a substantially completely compacted configuration of minimal height, particularly with a watertight seal mounted thereon to confine any residue in the now empty container, allows the used container to be conveniently stored or packed away in a "brown bag", knapsack, picnic hamper, or the like, for subsequent cleaning and reuse.

Another significant aspect of the container of the invention is its capability to fold open in increments, one section at a time, to vary the capacity thereof and to maintain its incrementally folded position.

Another significant aspect of the invention is the optional provision of a foot extending from the base of the container, which assists the user in extending the container from its collapsed or folded configuration to an expanded position, without contaminating the inside surfaces of the container that will come into contact with the beverage, or the like. This is particularly desirable where the container is used to store beverages, or other foodstuffs, for infants and children, where an uncontaminated environment is particularly desirable.

Another significant aspect of the invention is the provision of two materials of differing hardness, flexibility, or rigidity in the collapsible section of the container. This allows the container to be collapsed with less force than is required for existing containers having a collapsible section comprised of only one type of material, and is particularly desirable where the container is to be used by children or elderly persons having limited mobility or dexterity in their hands and/or fingers.

Another significant aspect of the invention is the provision of a collapsible container design that will allow a more vertical sidewall, compared to existing collapsible containers, as is typically required, and more advantageous, for a tumbler for drinking.

Other desired features of the invention include providing a container which can be washed in a dishwasher in its collapsed or expanded configuration, and stacked economically therein in the same manner as conventional dishes; a container which stays open when in use and stays closed in storage; and a container which maximizes usable space for packing in a shipping carton as well as storage in the home.

In order to achieve the improved and highly practical container of the invention, the peripheral wall of the container, extending between a substantially hard, rigid base and a substantially hard, rigid top ring adapted to receive a snap-fit seal, includes a series of generally hard, rigid annular or peripherally continuous wall sections intimately bonded to the flexible or soft peripheral wall. The resulting container wall thus comprises alternating sections that are soft and flexible relative to the rigid annular wall sections, and relative to the base and top ring. The rigid wall sections and soft wall sections, in the expanded or open position of the container, and sequentially upwardly from the base to the top ring, are each generally diametrically or peripherally progressively greater than the base. The configuration thus formed for the expanded container will be that of an inverted truncated cone with the wall sections basically outwardly stepped upward from the base. This, in turn, allows for a direct downward collapsing of the wall sections into concentric surrounding relation to the base with the top ring surrounding the collapsed wall sections.

The actual collapsing of the wall sections relative to each other occurs as each individual flexible wall section folds back, in an inverted manner, onto the rigid wall section immediately below, as a positive physical force is applied to the base and top ring.

Furthermore, each of the flexible wall sections includes a central corrugated area which, in transverse cross section, comprises flexible wall material of alternating thicknesses, producing a plurality of horizontal corrugations on the outside surface of the flexible wall sections, the area between each adjacent corrugation being defined by a "living hinge". With minimal user manipulation, these corrugations direct the flexible wall sections to flex and collapse in the desired direction and manner when physical force is applied to the base and top ring. In the absence of these corrugations, the flexible wall sections would "jam" in the process of collapsing the container, requiring the user to manipulate each ring individually. The corrugations also provide friction between the flexible and rigid wall sections in the collapsed or folded configuration of the container, to achieve and maintain the minimum height of the container in the collapsed or folded position.

Each of the flexible wall sections also includes upper and lower corrugation-free or "stress relief" areas on either side of the central corrugated area. These stress relief areas assist in maintaining the container in its minimum collapsed height, by relieving stress in the flexible wall material at the point where the flexible wall section folds back on itself as the container is collapsed, as will be more fully explained. The presence, otherwise, of a corrugation at this position would produce additional compression stress that would tend to relieve itself by extending the container upward somewhat from its collapsed configuration.

The size of the stress relief area is critical in that, if this area is too great, the flexible wall sections will "jam" while in the process of collapsing, due to a lack of direction provided by the corrugations, as aforementioned. Conversely, if the stress relief area is too small, the compression stress in the collapsed position will tend to extend the container from its collapsed position.

In a first embodiment of the collapsible container, the application of a positive physical force collapsing the top ring and base toward each other causes each of the flexible wall sections to reversely move over itself into an inside out or inverted position, as the top ring, intermediate ring sections, and base, all of different diameters, are moved into telescopic relation. This inverting of each flexible wall section over itself and onto the adjacent intermediate ring section or base, begins at a stress relief area located toward the lower peripheral edge of each soft wall section. As a positive physical force is maintained, each flexible wall section continues to roll back over itself and onto the adjacent intermediate ring section or base, as the top ring, intermediate rings, and base are moved into telescopic relation. In this way, the container will collapse telescopically as each flexible wall section folds over the intermediate ring or base section below.

Expansion of the container from its collapsed position will involve a downward pull on the base or foot, as the top ring is moved vertically upward therefrom. As the flexible wall portions of the wall sections unfold, the wall will tend to rigidify and in effect lock the container in the open position.

The foregoing is considered illustrative of the principles of the invention. As modifications and changes may occur to those skilled in the art, it is not desired to limit the invention to the exact construction and manner of use as shown and described. Rather, all suitable modifications and equivalents may be resorted to as falling within the scope of the invention.

BRIEF DESCRIPTION OF THE DRAWINGS

FIG. 15 is a partial cross-sectional view showing a possible collapsing sequence for the second embodiment of the container;

FIG. 16 is transverse cross-sectional view of the expanded container; and

DESCRIPTION OF THE PREFERRED EMBODIMENTS

The preferred embodiment of the invention is described and illustrated in the nature of a container. It will be appreciated, however, that the collapsible container of the invention also may take the form of a cup or bowl, and like receptacles, which are also considered to be within the scope of the claimed invention.

The foregoing goals of the invention are basically achieved by at least a two-step method or process of molding, normally referred to as a co-injection process. The practice of the co-injection process of the present invention may be characterized as a multi-injection "2C", i.e., two component, process.

In the multiple component co-injection process of the present invention, generally in a first molding step, a rigid base component, a rigid top ring component, and rigid intermediate ring components are molded, and then, in a second molding step, a flexible wall component is over-molded and bonded to the rigid top, base and intermediate ring components, to form the container. The bonding may be via chemical adhesion of an autogenous or adhesive nature.

It can be envisaged that more than two molding steps could be used to manufacture the collapsible container of the present invention. For example, a five-step molding process could be used, in which the base is molded in a first step, the lower intermediate ring is molded in a second molding step, the upper intermediate ring is molded in a third molding step, the top ring is molded in a fourth molding step, and the peripheral wall is over-molded and bonded to the top, base, and intermediate ring components in a fifth molding step. Naturally, only a four-step molding method would be required to manufacture a collapsible container of the invention having a single intermediate ring, rather than two intermediate rings.

As will further be appreciated, the base, intermediate rings, top ring, and peripheral wall can be transparent, translucent or opaque, and may have color. In this regard, it is contemplated that materials having different degrees of opacity and different colors can be used, in order to make the finished article aesthetically pleasing to a consumer. Optionally, each of the base, intermediate rings, top ring, and peripheral wall is molded in a separate step, using materials of different color.

Preferably, the container is molded in the open or expanded configuration, which will result in material memory that tends toward an open or expanded position of the container. This makes the final container product less prone to unintentional collapsing, and accordingly a safer product, especially when the container is used to hold, store, or transport hot liquids.

Figure 1:
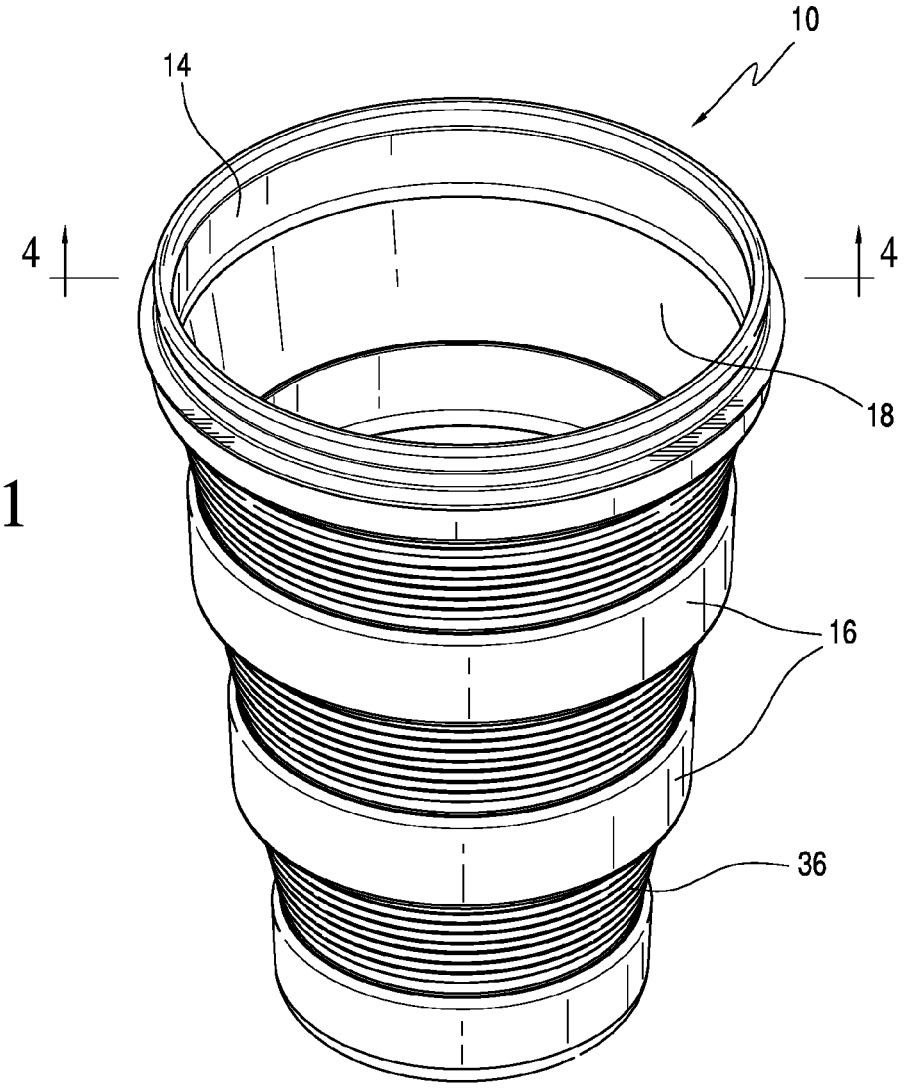
FIG. 1 is a top perspective view of a first embodiment of the container of the invention in its open or expanded position.
Figure 2:
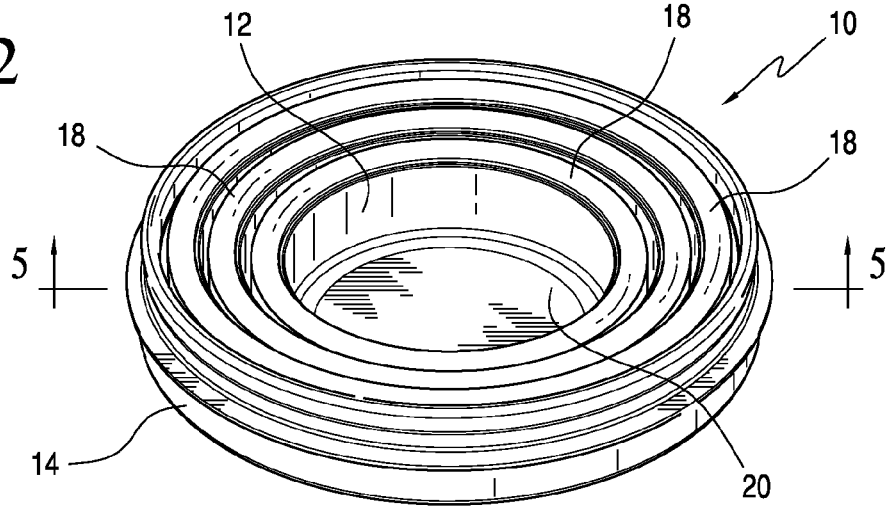
FIG. 2 is a top perspective view of the container fully collapsed.
Figure 4:
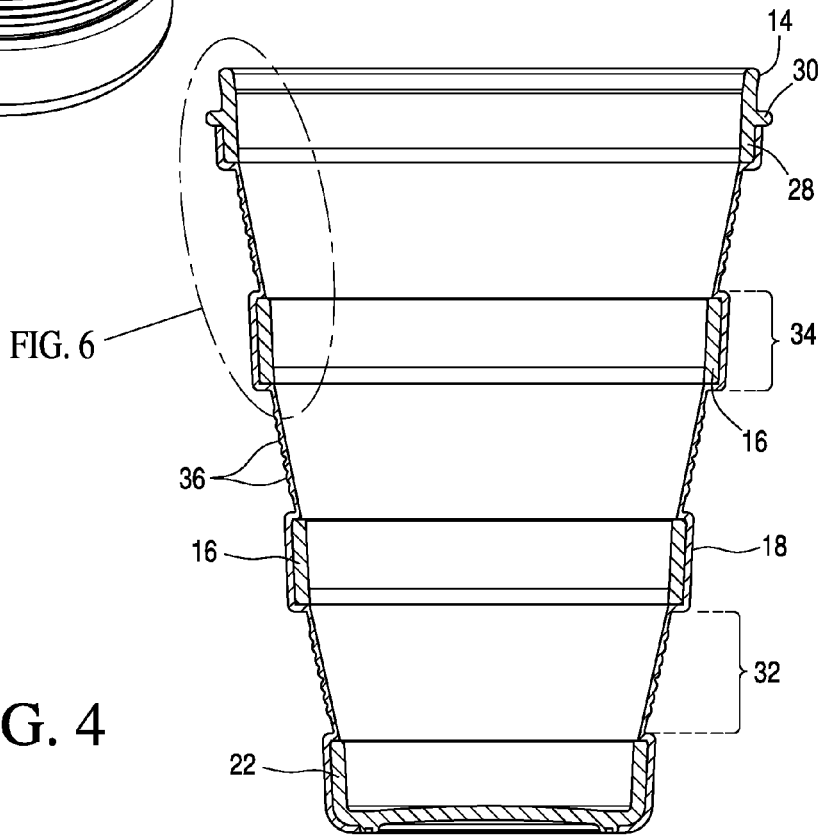
FIG. 4 is a transverse cross-sectional view of the expanded container.

Referring now more specifically to the drawings, and with particular attention to FIGS. 1, 2 and 4, a first embodiment of the collapsible container 10 comprises a base 12, a top ring 14, and a plurality of substantially rigid intermediate rings 16 disposed therebetween. The peripheral wall 18 of the container 10, which extends from the base 12 to the top ring 14, comprises a soft, flexible material that is over-molded to the base 12, top ring 14, and rigid intermediate rings 16, to form the collapsible container 10, as will be described more fully below.

Figure 12:
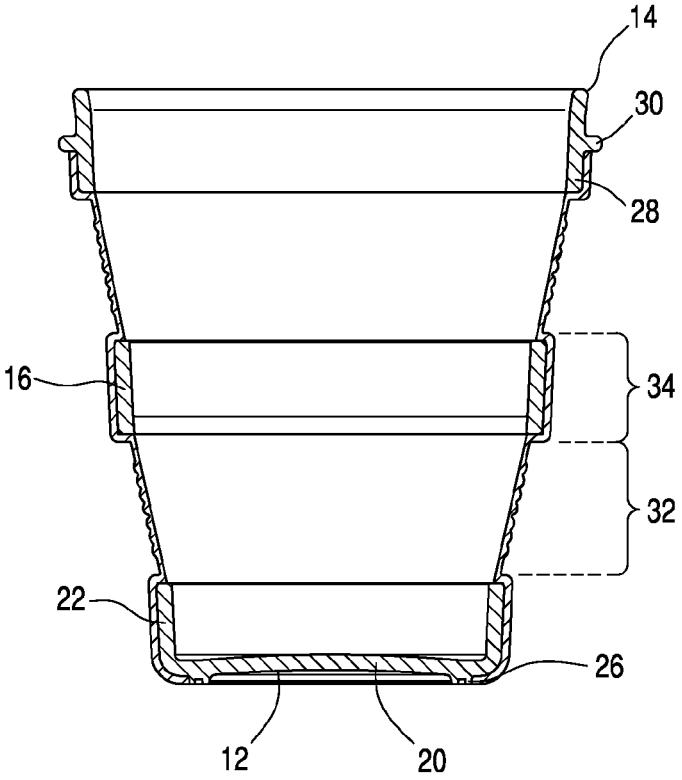
FIG. 12 is a similar view to FIG. 4 illustrating an embodiment with one intermediate ring.
Figure 13:
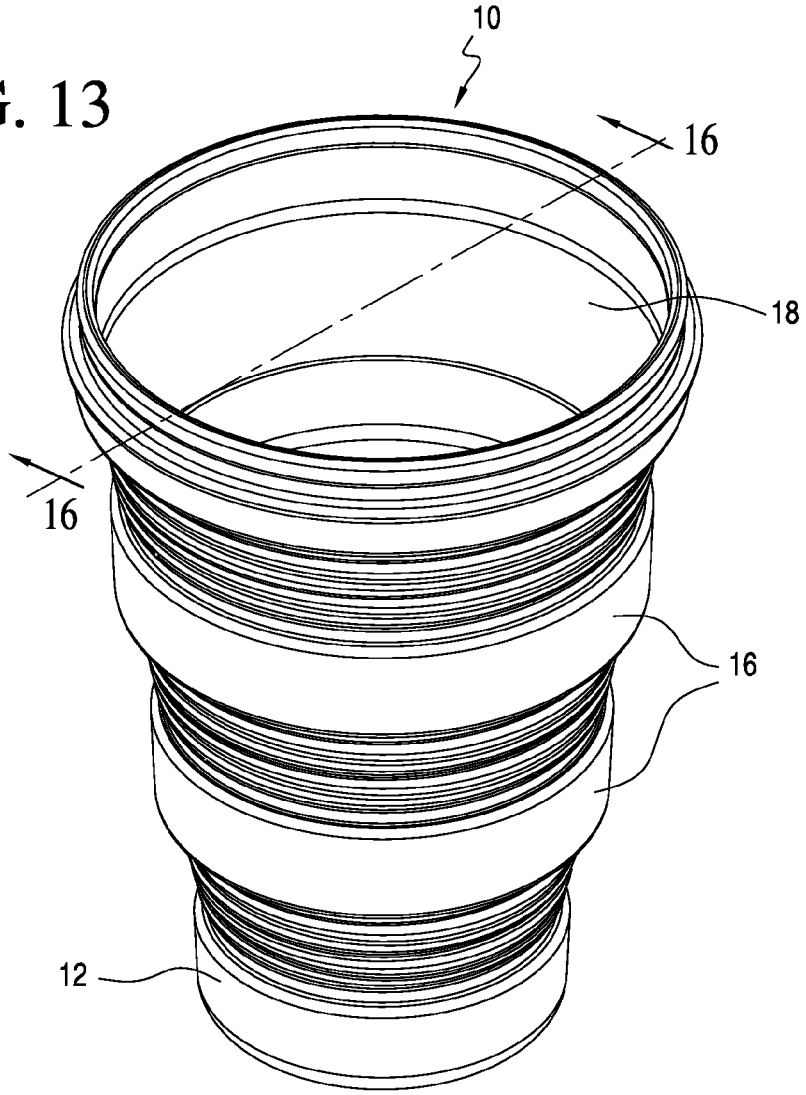
FIG. 13 is a top perspective view of a second embodiment of the container of the invention in its open or expanded position.
Figure 14:
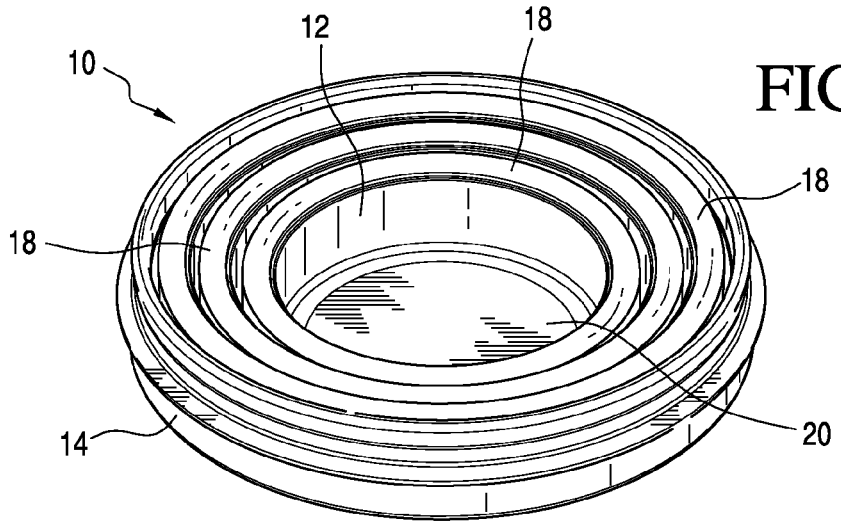
FIG. 14 is a top perspective view of the container fully collapsed.

In an alternative embodiment of the invention, only one intermediate ring 16 is present in the container wall (FIG. 12).

The flexible material of the peripheral wall 16 may also be defined as being pliable, bendable, and/or foldable.

The base 12 is a substantially rigid member including a flat bottom 20 and a peripheral upstanding base wall 22.

Figure 5:
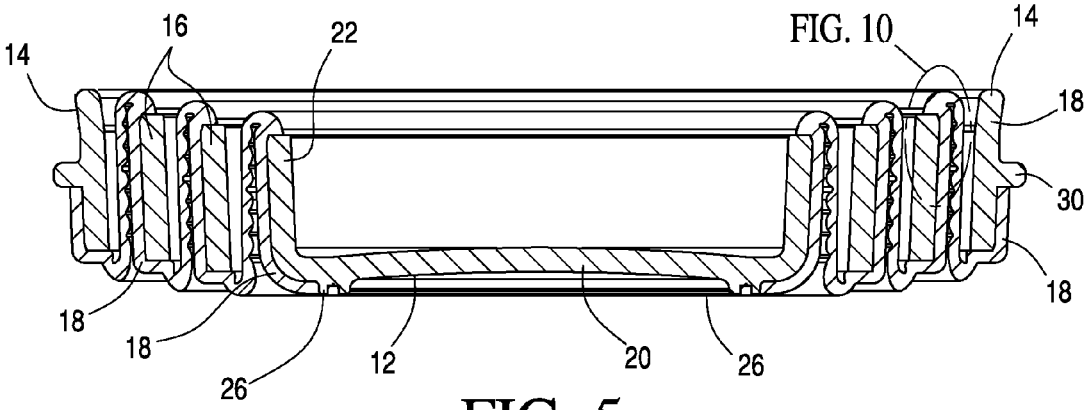
FIG. 5 is a transverse cross-sectional view of the collapsed container.
Figure 11A:
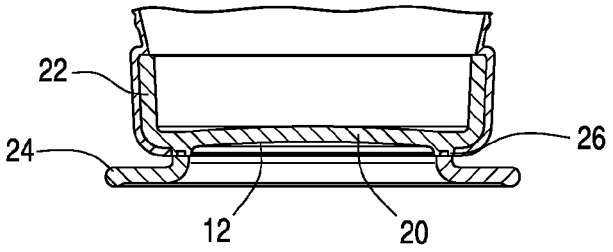
FIG. 11A is a partial transverse cross-sectional view illustrating a modified construction of the base of the container.
Figure 11B:
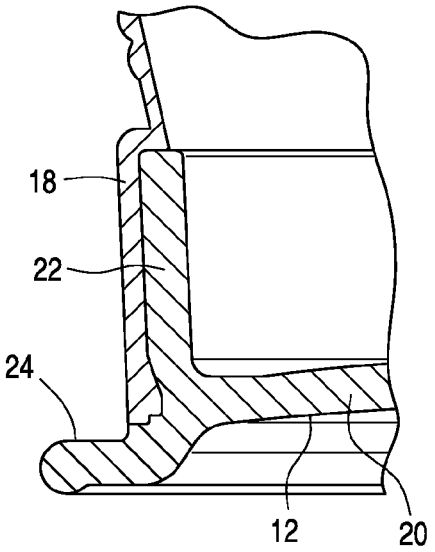
FIG. 11B is a partial transverse cross-sectional view illustrating a further modified construction of the base of the container.

Referring now to FIGS. 11A and 11B, the base 20, which preferably may be slightly upwardly convex toward the top of the container 10, as shown in FIGS. 4 and 5, optionally may include a foot 24 depending from the base bottom 20, to provide a stable platform for the container 10, and to assist in expanding the container, as shall be described subsequently. The foot 24 is preferably molded as a separate component, as shown in FIG. 11B, and then permanently secured to the base 12, for example by bonding or gluing. Optionally, the foot 24 may be integrally molded with the base, as shown in FIG. 11B. In the embodiment of the invention shown in FIG. 11A, wherein the foot 24 is molded separately from the base 12, the base 12 will also optionally have a continuous, circular foot rib 26 depending from the base bottom 20, to which the foot 24 is secured.

Referring now to FIG. 4, the top ring 14 includes a continuous or annular ring wall 28, and a peripheral, horizontally outwardly directed flange 30 at approximately mid-height on the ring wall 28. The top ring 14, similar to the base 12, is substantially hard or rigid, and is of a greater diameter than the base 12 to encircle the base 12 in the collapsed position of the container 10, as shown in FIGS. 2 and 5, sufficiently outward thereof to accommodate the collapsed container wall therebetween. The top ring flange 30 provides additional lateral stiffness to the top ring, as well as a convenient means for handling the container, especially when filled. In addition, the top ring flange 30, when the collapsed container is to be opened, allows a user to easily engage fingers of one hand about and under this flange 30 while pulling downward with the fingers of the other hand on the foot 24, to forcibly vertically expand the base and top ring relative to each other.

The peripheral wall 18 is formed of soft or flexible material, and is over-bonded to the top ring 14 and base 20, respectively, at the upper and lower peripheral boundaries of the wall, and to the intermediate rings 16 in the central portion of the container. Referring to FIG. 4, the container is thus made up of a series of annular or peripherally continuous wall sections of flexible wall material 32, alternating with rigid rings over-molded with flexible wall material 34.

Figure 6:
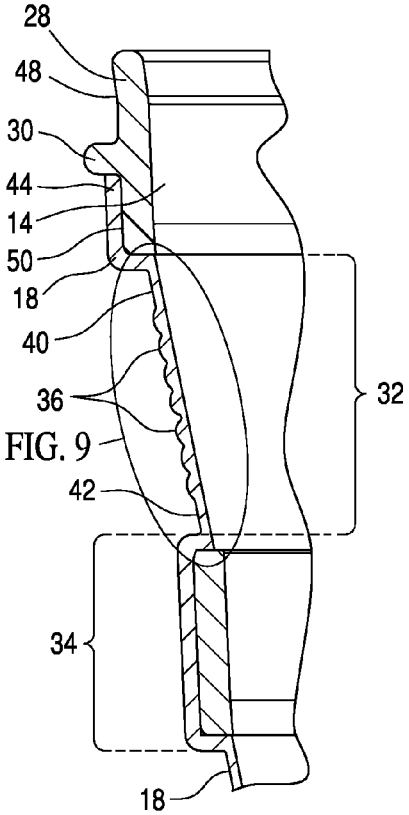
FIG. 6 is an enlarged detailed view of the area designated in FIG. 4.

Referring now to FIGS. 1 and 4, and in particular to FIG. 6, it will be noted that each of the flexible wall sections 32 includes corrugations 36 in the central area thereof which, in transverse cross section, comprise flexible wall material of alternating thicknesses, producing a plurality of horizontal corrugations on the outside surface of the flexible wall sections 32. With minimal user manipulation, the corrugations 36 direct the flexible wall sections 32 to flex and collapse in the desired direction and manner when physical force is applied to the base 12 and top ring 14, as will be explained more fully.

Figure 9:
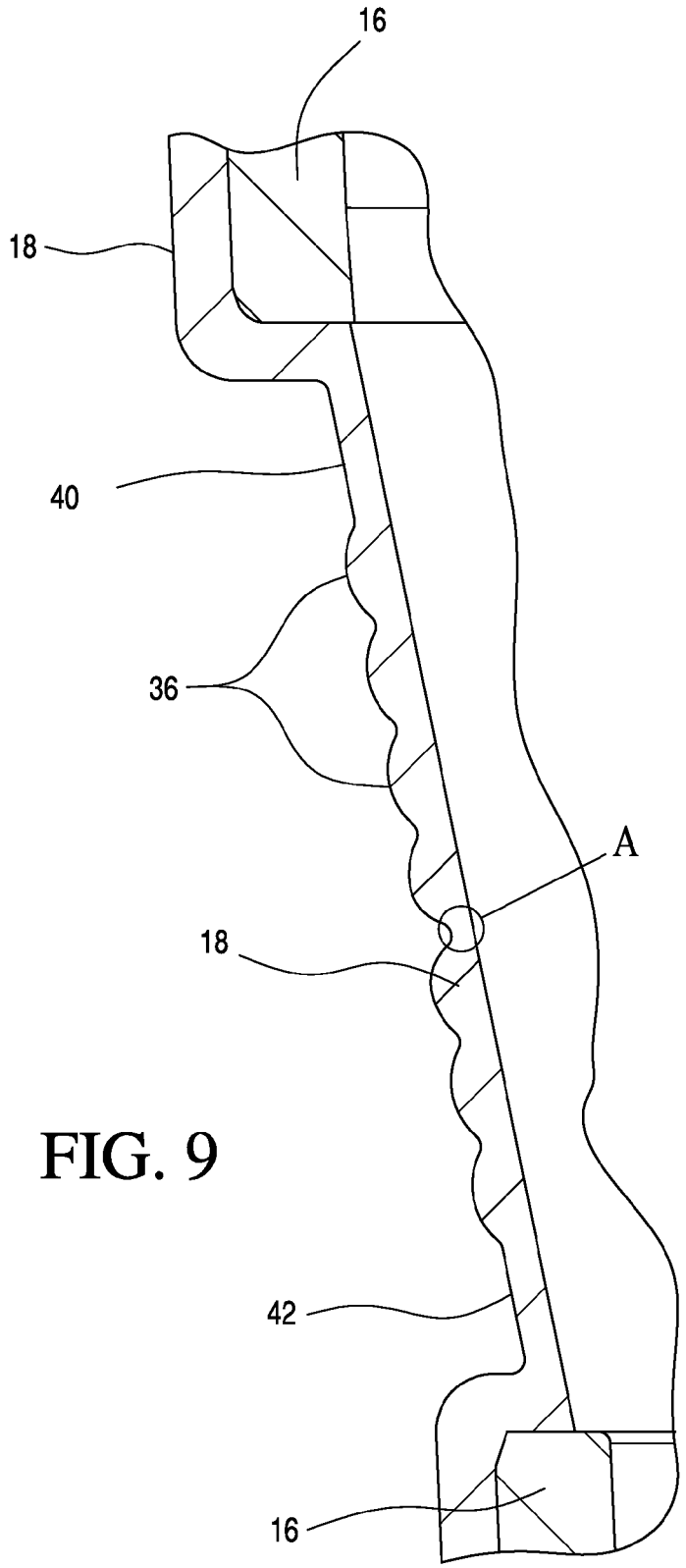
FIG. 9 is an enlarged detailed view of the area designated in FIG. 6.

Noting, in particular, FIG. 9, and FIG. 6 generally, it is noted that the peripheral wall 18, or living hinge, between two adjacent corrugations 36 that are located in an area approximately just below the middle of the wall sections 32 (area "A" in FIG. 9), is thinner than the peripheral wall, or living hinge, between two adjacent corrugations 36 located above and below area A. This thinner peripheral wall section, or living hinge, is present in the flexible wall material 32 located between the top ring 14 and upper intermediate ring 16, between the upper and lower intermediate rings 16, and between the lower intermediate ring 16 and the base 12. The thinner peripheral wall area A results in a tendency for the wall section 32 to begin to collapse at the location of the thinner wall area A. It will be appreciated that locating the thinner living hinge towards the middle of the wall section 32 promotes a more controlled collapse as pressure is applied to the container.

Figure 10:
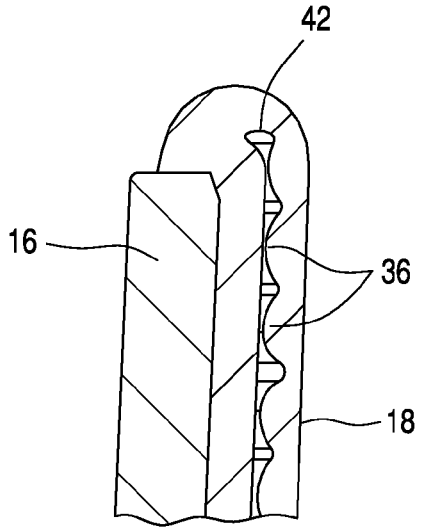
FIG. 10 is an enlarged detailed view of the area designated in FIG. 5.

As shown in FIG. 6, each of the flexible wall sections 32 also includes upper 40 and lower 42 corrugation-free or "stress relief" areas on either side of the central corrugated area 36. These stress relief areas 40, 42 assist in maintaining the container 10 in its minimum collapsed height, by relieving stress in the flexible wall material at the point where the flexible wall section 32 folds back on itself as the container is collapsed, particularly noting FIG. 10 in this regard. The presence, otherwise, of a corrugation at these positions would produce additional compression stress, that would tend to relieve itself by extending the container upward somewhat from its collapsed configuration.

As shown in FIGS. 4 and 5, the lowermost section of the peripheral wall 18 encircles and is intimately bonded to the wall 22 of base 12, continuing under the inwardly curved lower peripheral edge of the base 12, and terminating at the location of the downwardly extending foot rib 26 located on the bottom 20 of the base 12. The peripheral wall 18 is intimately bonded to the base 12, for example autogenously, during a multi-component molding procedure.

The container wall sections, upward from engagement of the lowermost section 32 with the base 12, are thus alternately sections of flexible wall material, designated sections 32, alternating with rigid rings over-molded with flexible wall material, designated sections 34.

Noting FIG. 6, in particular, the peripheral wall 18 terminates in an upwardly directed collar 44 received and intimately fixed to the lower edge portion of the ring wall 28 below flange 30, for example, in the manner suggested with regard to the lowermost section.

Figure 3:
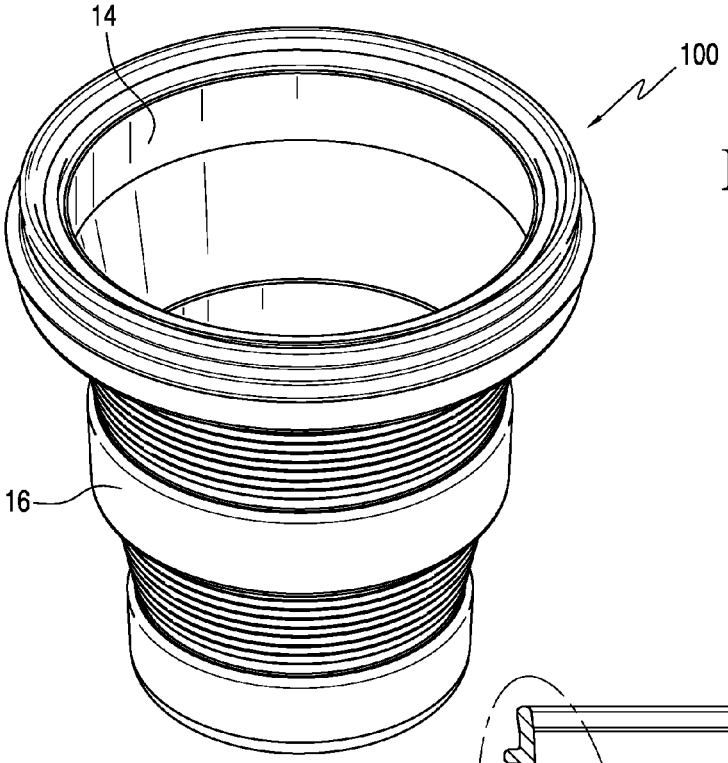
FIG. 3 is a top perspective view of the container of the invention in its partially open or expanded position.

FIG. 3 is of particular interest in showing the container partially collapsed for use when a reduced capacity is desired or required. In the configuration shown, only the uppermost flexible wall section 32 is shown collapsed onto the rigid wall section 34 immediately below. In such a position, the container is fully functional to receive and store foodstuffs and the like, and the seal 42, as in the open container of FIG. 3, is also fully functional in that the top ring is dimensionally stable in every position of the container.

Noting in particular FIGS. 4 and 12, it will be seen that the general outward stepping of the sections upward from the base to the top ring form, in the open container, has a generally inverted truncated conical configuration.

Figure 7:
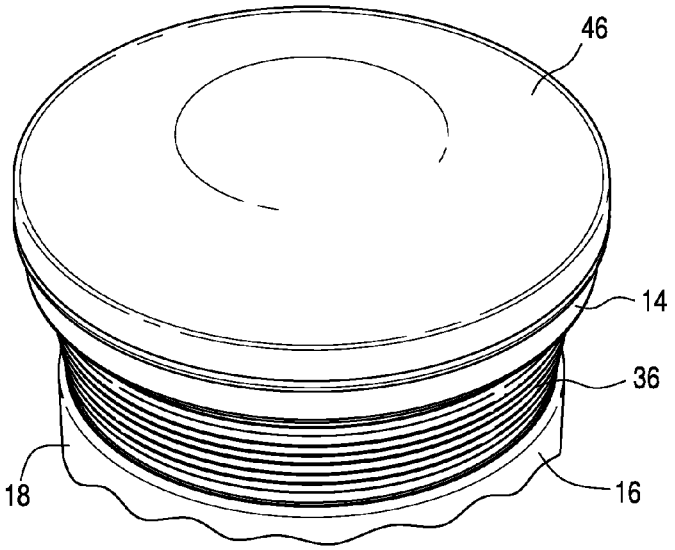
FIG. 7 is a partial top perspective view of the container with the seal snap-fitted to the expanded container.
Figure 8:
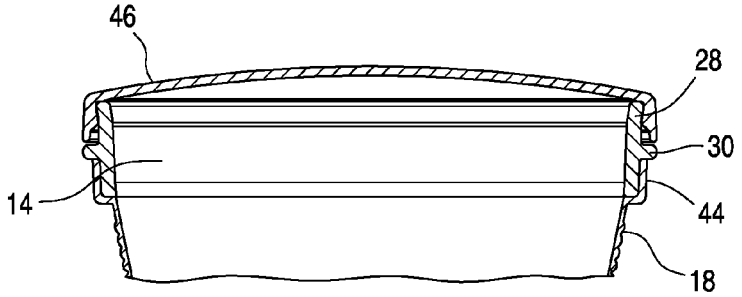
FIG. 8 is a partial transverse cross-sectional view of the expanded container with the seal snap-fitted thereto.

Referring now to FIGS. 7 and 8, it will be seen that a seal 46 is capable of being snap-fitted to the top ring 14 in an appropriate manner in any position assumed by the container. To facilitate this engagement, and noting now FIG. 6, the upper portion 48 of the top ring wall 28, above the circumferential flange 30, may be slightly outwardly inclined for reception within a peripheral downwardly directed groove on the inner surface of the seal 46. It is to be appreciated that inasmuch as the wall sections 32, 34 are, in any position of the container, positioned concentrically inward of the substantially rigid top ring 14, the seal 46 functions as an appropriate closure for the open container, the partially expanded container, and the collapsed container wherein a compacted storage position is achieved.

A second embodiment of the collapsible container 10 is shown in FIGS. 13 to 18, wherein elements which are common to the first embodiment of the invention are indicated by like reference numerals. The base 12, top ring 14, peripheral wall 18, base bottom 20, and plurality of substantially rigid intermediate rings 16, are manufactured and configured substantially as shown and described hereinabove for the first embodiment depicted in FIGS. 1 to 12.

The collapsible container of the second embodiment of the invention may also optionally include a foot 24, depending from the base bottom 20, which is preferably molded as a separate component, as shown in FIG. 11B, and then permanently secured to the base 12, for example by bonding or gluing. Optionally, the foot 24 may be integrally molded with the base, as shown in FIG. 11B.

Figure 17:
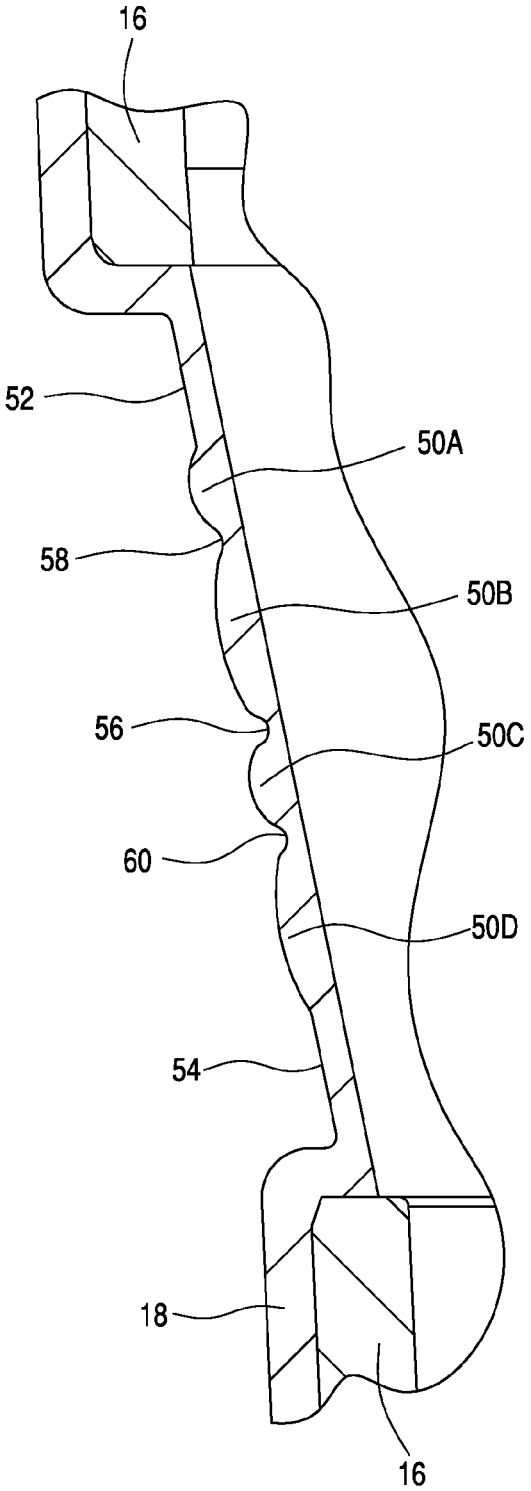
FIG. 17 is a first enlarged detailed view of a first area designated in FIG. 16.
Figure 18:
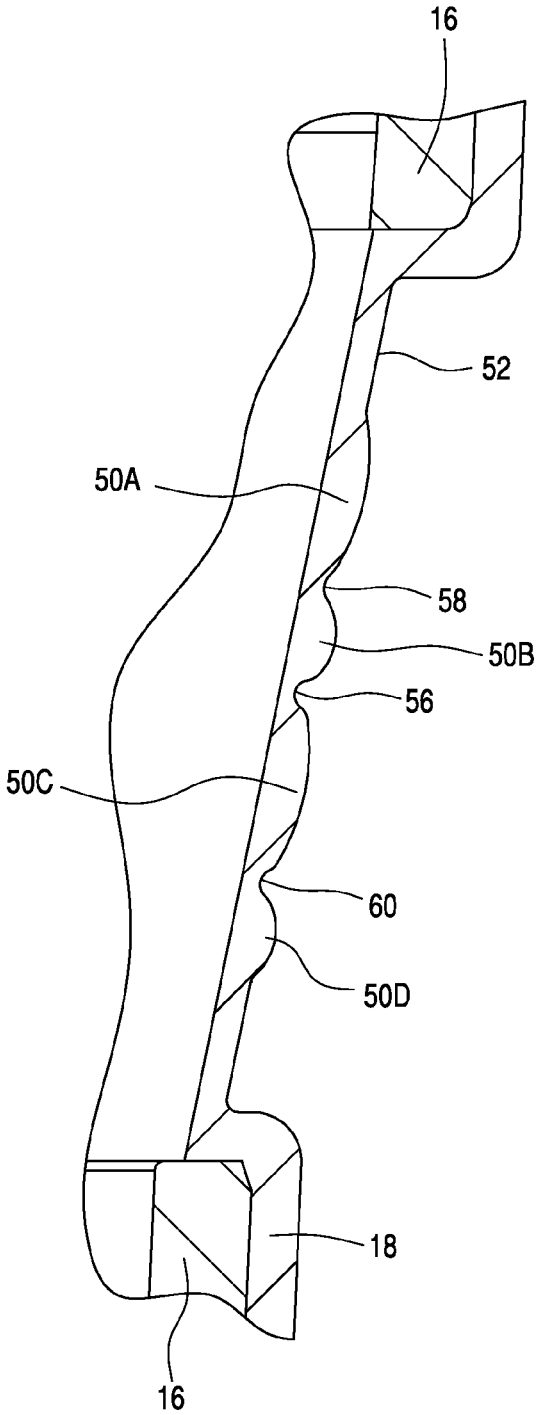
FIG. 18 is a second enlarged detailed view of a second area designated in FIG. 16.

Referring in particular to FIGS. 17 and 18, it will be noted that each of the flexible wall sections 32 includes corrugations 50A, 50B, 50C, and 50D, in the central area thereof which, in transverse cross section, comprise bands of flexible wall material of different thicknesses, producing a plurality of angled corrugations on the outside surface of the flexible wall sections 32.

As a result of the angular configuration of the living hinges from one side of the container to the other, the height of the corrugations above and below the upper 58, central 56, and lower 60 living hinges varies from one side of the container to the other.

As will be noted from FIG. 17, the height of the corrugation 50B below the upper living hinge 58 is approximately twice the height of the corrugation 50A above the living hinge 58, on one side of the container. As seen in FIG. 18, on a side of the container diametrically opposite the side of the container shown in FIG. 17, the height of the corrugation 50B above the upper living hinge 58 is approximately twice the height of the corrugation 50A below the living hinge 58. Between these two diametrically opposite sides of the container, the height of the corrugations (50A, 50B, 50C, 50D) above and below the angled upper 58 and lower 60 living hinges decreases (or increases) from one side of the container to the other. As will be appreciated, at the midpoint between two diametrically opposite sides of the container, the height of the corrugations above and below the upper 58 and lower 60 living hinges will be approximately equal.

This variation in height of the corrugations results in corrugations 50B, 50D that are stiffer than the adjacent shorter corrugations 50A, 50C. It appears that the controlled collapse of the container is facilitated by a combination of the thinner hinge 56 and the thicker (stiffer) corrugations 50B, 50C on one side of the container to the other.

When the container is compressed, this height difference produces a force imbalance in opposite directions on opposite sides of the container, which in turn makes the flexible material fold on itself.

This is the preferred height ratio. Any other height ratio will work as long as there is enough difference to produce an imbalance of forces.

Each of the flexible wall sections 32 includes upper 52 and lower 54 corrugation-free or "stress relief" areas bounding the central corrugated area. As with the first embodiment of the invention, these stress relief areas 52, 54 assist in maintaining the container 10 in its minimum collapsed height, by relieving stress in the flexible wall material at the point where the flexible wall section 32 folds back on itself as the container is collapsed.

As can be seen from FIGS. 16-18, the central corrugated area is formed of a series of four corrugations 50 connected to one another by central 56, upper 58, and lower 60 living hinges, as will be explained more fully.

The upper 58 and lower 60 living hinges are angled with respect to the horizontal plane of the container, while the central living hinge 56 is substantially horizontal with respect to the horizontal plane.

Referring now to FIGS. 17 and 18, it can be noted that the thickness of the peripheral wall 18 forming living hinges 56, 58, and 60 is different for each living hinge. More particularly, the thickness of the peripheral wall 18 at the location of the central living hinge 56 is less than the thicknesses of the peripheral wall 18 at the location of both the upper 58 and lower 60 living hinges. Further, the thickness of the peripheral wall 18 at the location of the upper living hinge 58 is greater than the thickness of the peripheral wall at the location of the lower 60 living hinge. This arrangement results in the peripheral wall 18 being thinnest at the location of the central living hinge 56, and thickest at the location of the upper living hinge 58.

In a preferred embodiment, the thickness of the peripheral wall 18 at the location of the upper living hinge 58 is 0.58 mm (0.023 in); the thickness of the peripheral wall 18 at the location of the central living hinge 56 is 0.38 mm (0.015 in); and the thickness of the peripheral wall 18 at the location of the lower living hinge 60 is 0.48 mm (0.019 in). The living hinge thickness could be as thin as 0.25 mm (0.010 in), and can be as thick as 0.76 mm (0.030 in).

Referring now to FIG. 15, a possible collapsing sequence of the container is shown when physical force is applied to the base 12 and top ring 14. In this regard, it is considered that, generally, the flexible wall section 32 having the greatest diameter, namely, the flexible wall section immediately below the top ring 14, will be the first flexible wall section to collapse as physical force is applied. Following this, the flexible wall section 32 having the second greatest diameter, namely, the flexible wall section between the two intermediate rings 16 will be the next flexible wall section to collapse as physical force is applied. Finally, the flexible wall section 32 having the least diameter, namely, the flexible wall section immediately above the base 12 will be the last flexible wall section to collapse as physical force is applied.

It is also considered that the living hinge with the thinnest peripheral wall, namely, the central living hinge 56, will be the first living hinge to collapse as physical force is applied. Following this, the lower living hinge 60, which is the second thinnest living hinge, collapses. Finally, the living hinge having the thickest peripheral wall, namely, the upper living hinge 58 will be the last to collapse.

Furthermore, as a result of the upper 58 and lower 60 living hinges being disposed at an angle relative to the horizontal plane of the container, there is a tendency for one side of the container to collapse first, in all three sections of the container.

It will be appreciated, of course, that the sequence of collapse of the container cannot be precisely ascertained, and the sequence that occurs in use will depend on a combination of a number of factors, including, for example, the extent of the physical force applied to the base 12 and top ring 14, the manner in which the user grasps the base 12 and top ring 14, and the angle at which physical force is applied as the user pushes the base 12 and top ring 14 toward each other.

As previously noted, when the container is to be expanded or opened prior to use, one need merely engage fingers of one hand about peripheral flange 30 of the top ring 14 and, with fingers of the other hand engaged about base 12, or the rim or flanged area of the foot 24, exert a downward pull on the base 12 or foot 24 to partially or fully expand the container 10. It will be appreciated that, with the seal 46 fitted onto the top ring 14 of the container 10, the container can be opened or expanded without contaminating the inner surfaces of the container 10 which will come into contact with beverages or foodstuffs.

When the container 10 is in a fully collapsed configuration, the collapsed wall sections and top ring are retained slightly above a support plane defined by the base bottom 20, rather than on the collapsed wall sections of the collapsed container 10.

The container 10 of the invention is preferably molded in the open or expanded configuration. Open is thus the natural state for the container, that is the container would 'prefer' to remain open than in any other position. Optionally, the container of the invention may be molded in a flattened or collapsed position.

The unique structure of the invention allows the container to remain flat when in the closed or collapsed position, and remain expanded when in any open or partially open position. The relative hardness of the rigid intermediate rings 16 compared to the flexible wall sections 32, and the strengthening effect provided by the corrugations 36 present in the flexible wall sections 32, provide the necessary structural support to keep the container open when expanded.

As noted previously, the container 10 prefers to remain closed when collapsed flat, and prefers to remain open when expanded. The container is capable of opening to fixed partial capacities by folding over of one or more flexible wall sections 32 onto its associated rigid wall section 34 below, because the container prefers to remain open in these partial configurations. This is of particular value in maximizing and optimizing storage space as in a refrigerator, and dishwasher space when washing.

The collapsible container 10 of the present invention has been described in the preferred embodiment as comprising one of molded plastic, i.e. synthetic polymers, having 'separate entities' comprising a base 12, top ring 14, intermediate rings 16, and peripheral wall 18. The 'separate entities' in a preferred molding method may, for example, be realized by utilization of a molding apparatus that enables multiple stage molding of the base 12, top ring 14, intermediate rings 16, and peripheral wall 18, and wherein selection of polymers of varying degrees of substantial rigidity and/or general rigidity may be utilized. This also enables the varying of the color or light transmissivity of the base 12, top ring 14, intermediate rings 16, and peripheral wall 18.

The molding of the base 12, top ring 14, and intermediate rings 16 as separate entities from the peripheral wall 18 is a preferred method of molding, enabling the provision of substantially greater rigidity to these components relative to the flexible wall sections 32, wherein the actual extending and collapsing action occurs by utilization of polymers of differing degrees of rigidity, and/or flexibility.

It will be appreciated that the described preferred difference in relative rigidity, or general, but more flexible, rigidity of the base 12, top ring 14, and intermediate rings 16 vis-a-vis the peripheral wall 18, may be achieved by providing a molding apparatus wherein a mold is configured to provide selected areas of the mold interior with polymers of varying degrees of rigidity or flexibility for the base 12, top ring 14, intermediate rings 16, and peripheral wall 18.

The foregoing is considered illustrative of the principles of the invention. As modifications and changes may occur to those skilled in the art, it is not desired to limit the invention to the exact construction and manner of use as shown and described. Rather, all suitable modifications and equivalents may be resorted to as falling within the scope of the invention as claimed.

What is claimed is:

1. A collapsible container having a plurality of sections, said collapsible container comprising:

a rigid top ring;

a rigid base;

two or more rigid intermediate rings disposed between said top ring and said base; and a flexible wall peripherally fixed to said base, said top ring, and said two or more rigid intermediate rings, wherein said flexible wall is over-molded and bonded to said base, said top ring, and said two or more intermediate rings; wherein:

said collapsible container is adjustable between an expanded position with the top ring spaced upward from said base and forming a container interior, and a collapsed position with said top ring surrounding said base in outwardly spaced substantially concentric relation thereto.

2. The collapsible container of claim 1, wherein the sections include a lowermost section joined to said base, a topmost section joined to said top ring, and intermediate sections between said lowermost and topmost sections, said sections, from said lowermost section to said topmost section each sequentially defining a peripherally encompassed area generally progressively greater than the base.

3. The collapsible container of claim 2, wherein said lowermost section joined to said base comprises said flexible wall, and said topmost section joined to said top ring comprises said flexible wall.

4. The collapsible container of claim 1, wherein a foot is disposed on said base.

5. The collapsible container of claim 4 wherein the foot is molded separately from the base.

6. The collapsible container of claim 4, wherein the foot is molded integrally with the base.

7. The collapsible container of claim 1, wherein said flexible wall includes a central corrugated area.

8. The collapsible container of claim 7, wherein said central corrugated area is bordered by a corrugation-free stress relief area.

9. The collapsible container of claim 1, wherein said top ring includes an upwardly extending ring wall, and a separate seal disposed on said top ring and being releasably fixed to said ring wall in both the expanded and collapsed position of said collapsible container.

10. The collapsible container of claim 1, wherein said base has a bottom surface defining a support plane, said wall sections in the collapsed position of the collapsible container being positioned above said defined support plane.

11. The collapsible container of claim 1, wherein said top ring includes a circumferential outwardly extending flange defining a means for grasping the top ring as downward pressure is applied to said base.

12. The collapsible container of claim 1, wherein said top ring includes an upwardly extending ring wall, and a separate seal positionable over said top ring and being releasably fixed to said ring wall in both the expanded and collapsed position of said collapsible container.

13. The collapsible container of claim 1, wherein the flexible wall is laterally folded on a rigid ring immediately below in the collapsed position of the collapsible container.

14. The collapsible container of claim 1, wherein said central corrugated area comprises living hinges.

15. The collapsible container of claim 14, wherein said living hinges are formed from a narrowing of the flexible wall.

16. The collapsible container of claim 14, wherein a section comprising the flexible wall comprises three living hinges.

17. The collapsible container of claim 16, wherein the living hinges are formed from three different thicknesses of the flexible wall.

18. The collapsible container of claim 1, selected from the group consisting of a cup, tumbler, and bowl.

19. The collapsible container of claim 1, wherein said two or more rigid intermediate rings and said flexible wall form a collapsible section comprised of an alternating hard and rigid material and a relatively soft and flexible material.

20. The collapsible container of claim 1, wherein said two or more rigid intermediate rings are discrete rings.

* * * * *